US006019855A

United States Patent [19]

Finch et al.

[11] Patent Number: 6,019,855

[45] Date of Patent: Feb. 1, 2000

[54] PERFUMED COMPOSITIONS COMPRISING POLYMER AND NONIONIC SURFACTANT

[75] Inventors: Timothy David Finch, Wirral; Christopher Maddison, South Wirral; Martin Sharples, Wirral, all of United Kingdom

[73] Assignee: Home & Personal Care USA, New York, N.Y.

[21] Appl. No.: 08/644,550

[22] Filed: May 10, 1996

[30] Foreign Application Priority Data

May 11, 1995 [GB] United Kingdom ..... 9509603

[51] Int. Cl.[7] ..... B08B 3/04; C11D 1/72; C11D 3/50

[52] U.S. Cl. ..... 134/42; 510/102; 510/106; 510/421; 510/434; 510/477; 510/476

[58] Field of Search ..... 510/102, 106, 510/421, 434, 477, 476; 134/42

[56] References Cited

U.S. PATENT DOCUMENTS

| | | | |
|---|---|---|---|
| 4,414,128 | 11/1983 | Goffinrt | 252/111 |
| 5,240,633 | 8/1993 | Ahmed et al. | 252/99 |
| 5,298,180 | 3/1994 | Dixit | 252/94 |
| 5,336,428 | 8/1994 | Kaplan et al. | 252/162 |
| 5,368,843 | 11/1994 | Rennie | 424/49 |
| 5,441,666 | 8/1995 | Dotolo | 252/170 |
| 5,474,712 | 12/1995 | Dotolo et al. | 252/550 |
| 5,556,833 | 9/1996 | Howe | 510/189 |

FOREIGN PATENT DOCUMENTS

| | | |
|---|---|---|
| 216 416 | 1/1987 | European Pat. Off. . |
| 0 367 257 | 5/1990 | European Pat. Off. . |
| 0 525 892 | 2/1993 | European Pat. Off. . |
| 0 619 363 | 10/1994 | European Pat. Off. . |
| 0 275 085 | 7/1998 | European Pat. Off. . |
| 60 051 796 | 8/1958 | Japan . |
| 2 056 859 | 3/1981 | United Kingdom . |
| 2 194 787 | 3/1988 | United Kingdom . |
| 86/02369 | 4/1986 | WIPO . |

*Primary Examiner*—Yogendra Gupta
*Assistant Examiner*—Gregory R. Delcotto
*Attorney, Agent, or Firm*—Neil Y. Gilbert, Esq.

[57] ABSTRACT

The present invention relates to perfumed compositions comprising polymer and nonionic surfactant and is explained with particular reference to insect-repellent compositions which are a preferred embodiment of the invention. The invention provides an aqueous cleaning composition comprising: a nonionic surfactant, a carboxylate polymer, and, a perfume. Preferably the compositions of the invention are aqueous cleaning composition of pH 3.5–5.5 comprising:

a) 1–10% wt of an ethoxylated alcohol, b) 0.1–4% wt of a carboxylate polymer, c) 0.2–4% wt of a perfume component selected from the group comprising limonene, carvone, cineole, linalool, Gum Camphor, citronellal, alpha and beta terpenol, fencholic acid, borneol, iso borneol, bornyl acetate, iso bornyl acetate and mixtures thereof, and, d) 82–99% water, wherein the weight ratio of (a):(c) does not exceed 10:1.

4 Claims, No Drawings

PERFUMED COMPOSITIONS COMPRISING POLYMER AND NONIONIC SURFACTANT

TECHNICAL FIELD

The present invention relates to perfumed compositions comprising polymer and nonionic surfactant. The invention will be explained with reference to insect-repellent compositions which are a preferred embodiment of the invention.

BACKGROUND OF THE INVENTION

It is known to incorporate insect repellents or insecticides in cleaning compositions. GB 2056859 (published 1981) discloses compositions consisting essentially of the commercially available glass cleaner AJAX VITRE (RTM) and an insecticide.

PCT/US85/01944 (published 1986) teaches that monoalkyl phosphate insect repellents can be added to a detergent and used to wash objects and animals and thereafter will have a repellent effect which persists for some time.

EP 0367257 discloses insect repellents for incorporation into detergents since they are substantive for soft surfaces (eg humans, animals, laundry or rugs) and hard surfaces. The amount of the specific compound deposited on the washed surface is 0.2–10 (preferably 0.5–2) g/sqm. They can also be formulated as repellant sprays etc, as dispersions or solutions in liquid media. The compounds are said to be especially effective against cockroaches but can also repel spiders, ticks, mites, flies ants, etc.

EP 0619363 relates to aqueous liquid detergents which comprise a surfactant, at least 50% water and an effective amount of an insect repellent material. The compositions are free of insecticides. Amongst the insect-repellents mentioned are materials which are known insect repellents per se and also perfumes. Other materials can be present in the composition and these include soil release promoting agents, which may be polymers.

EP 0275085 relates to sprayable volatile insect repellent compositions comprising an insect repellent, propellant, solvent and a specific maleic anhydride/alpha-olefin polymer. The polymer is said to increase the residual activity of the insect repellant by forming a coating containing an insect repellent on articles treated with the neat composition. No surfactants are present in these compositions which require relatively high levels of polymer to be present in order to form an effective film.

A more general problem than that of insect-repellency is maintaining the persistence of a perfume after a surface has been cleaned with a cleaning composition over a prolonged period of time. The presence of a perfume is perceived by many consumers as an important indicator that the surface is clean. As discussed herein, perfumes often have other functions, one of which may be insect-repellency given that repellent chemicals can be included in a perfume composition. Perfumes are by their nature volatile substances and will be lost from a surface with the passage of time. Often, there is an initial high loss of perfume from the surface followed an extended period of release at a lower level. It is apparent that if the initial perfume loss can be reduced and the level of perfume above the surface be maintained at a higher level for a longer time, then the efficacy of the perfume both in the sensory and where present the insect-repellent aspects will be improved.

In the context of the present invention the term 'perfume' is meant to incorporate within its scope volatile insect repellent compositions whether these are perceptible by the use of the human nose or not. Other perfumes, which are not insect repellent are included within the broader scope of the term.

BRIEF DESCRIPTION OF THE INVENTION

We have determined that for compositions which comprise a non-ionic surfactant, the release profile of a perfume from surfaces which have been treated with the composition may be modified by the use of a carboxylate polymer.

We have also determined that the efficacy of the insect repellant is improved by the incorporation of a carboxylate polymer.

Accordingly the present invention provides an aqueous cleaning composition comprising:

a) a nonionic surfactant, b) a carboxylate polymer, and, c) a perfume.

Without wishing to limit the scope of the invention by reference to any theory of operation, it is believed that, the carboxylate polymer, either in combination with the nonionic, or otherwise entraps the perfume at the surface and promotes an extended release of the perfume at or from the surface. This differs from the essentially anhydrous surfactant-free films which have previously been used to provide prolonged insect repellency as this enables the aqueous surfactant present to fulfil a cleaning function in the same composition while providing a residual perfume benefit.

The present invention also relates to a method of cleaning a surface so as to impart a residual perfume benefit thereupon which comprises the step of contacting the surface with a composition according to the present invention. Most preferably the residual perfume benefit includes an insect repellency benefit.

DETAILED DESCRIPTION OF THE INVENTION

Surfactants

Nonionic surfactants are an essential component of the compositions according to the invention. The surfactants are preferably, alkoxylated alcohols or amine oxides although it is envisaged that other surfactants such as alkyl polyglucosides could be employed. Alkoxylated alcohols, particularly ethoxylated alcohols, are preferred.

Suitable nonionic detergent active compounds can be broadly described as compounds produced by the condensation of alkylene oxide groups, which are hydrophillic in nature, with an organic hydrophobic compound which may be aliphatic or alkyl aromatic in nature. The length of the hydrophillic or polyoxyalkylene radical which is condensed with any particular hydrophobic group can be readily adjusted to yield a water-soluble compound having the desired degree of balance between hydrophillic and hydrophobic elements.

Particular examples include the condensation product of aliphatic alcohols having from 8 to 22 carbon atoms in either straight or branched chain configuration with ethylene oxide, such as a coconut oil ethylene oxide condensate having from 1 to 15 moles of ethylene oxide per mole of coconut alcohol; condensates of alkylphenols whose alkyl group contains from 6 to 12 carbon atoms with 1 to 25 moles of ethylene oxide per mole of alkylphenol.

Particularly preferred nonionic surfactants include the condensation products of $C_8$–$C_{12}$ alcohols with 2–12 moles of ethylene oxide.

The amount of nonionic detergent active to be employed in the composition of the invention will generally be from 0.1 to 30% wt, preferably from 1 to 20% wt, and most preferably from 2 to 7% wt for non-concentrated products. Concentrated products will have 7–20% wt nonionic surfactant present, whereas dilute products suitable for spraying will have 0.1–10% wt nonionic surfactant present.

Alternative preferred surfactants include coconut ethanolamide and ethanolamine ethoxylates, and C12 amine oxide.

Polymers

Polymers are an essential component of compositions according to the present invention. It is essential that these polymers are carboxylate polymers. In the context of the present invention a carboxylate polymer is one formed from monomers which comprise a carboxy-functional group which is or can become charged in the final polymer. This group of polymers excludes polymers such as silicone oils and mineral oils.

The preferred polymers in embodiments of the present invention are polymers of acrylic or methacrylic acid and/or maleic anhydride, or a co-polymer of one or more of the same either together or with other monomers. Particularly suitable polymers include polyacrylic acid, polymaleic anhydride and copolymers of either of the aforementioned with ethylene, styrene and methyl vinyl ether.

The most preferred polymers are polyacrylic acids and maleic anhydride co-polymers, preferably those formed with styrene, acrylic acid, methyl vinyl ether and ethylene. Preferably, the molecular weight of the polymer is at least, 5000, more preferably at least 50,000 and most preferably in excess of 100,000. The molecular weight of the polymer is preferably below 1,000,000 Dalton.

A particularly suitable polymer is a polyacrylic acid of molecular weight 230000. This is available in the marketplace as 'VERSICOL E11,' (TM) ex. Allied Colloids.

Typically, the compositions comprise at least 0.01 wt % polymer, on product. Preferably the level of polymer is 0.05–5.0 wt %. More preferably 0.1–4.0 wt % of polymer is present. However, for very concentrated products which are diluted prior to use, the initial polymer level can be as high as 5% wt.

Preferably the ratio of polymer to nonionic is 0.1:1 by weight or less.

Perfume

An effective level of perfume is an essential component of the compositions of the present invention. It is particularly preferred that the perfume is an insect repellent.

Particularly suitable insect repellents include essential oils such as those of genus Mentha, particularly Mentha arvensis, mentha piperita, Mentha spicata and Mentha cardica; Lemongrass East Indian oil, Lemon oil, Citronella, Cedarwood and Pine oil; terpenoids, particularly limonene, carvone, cineole, linalool, Gum Camphor, citronellal, alpha and beta terpenol, fencholic acid, borneol, iso borneol, bornyl acetate and iso bornyl acetate.

The most preferred insect repellents are the terpenoids, particularly limonene.

The level of insect repellent required will vary with the nature of the material used. For essential oils and terpenoids, preferred levels are 0.1–5% on product.

It is preferred that the ratio of surfactant to insect repellent does not exceed 10:1 wt % and more preferably that the ratio of surfactant to insect repellent falls in the range 8–2:1.

It is preferred that the ratio of insect repellent to polymer is in the range less than 5:1 but more than 0.5:1. We have found that ratios of 4:1 of a perfume containing 54% insect repellent to polymer were effective.

Minors

The composition according to the invention can contain other minor, unessential ingredients which aid in their cleaning performance and maintain the physical and chemical stability of the product.

For example, the composition can contain detergent builders. In general, the builder, when employed, preferably will form from 0.1 to 25% by weight of the composition.

Metal ion sequestrants such as ethylene-diamine-tetra-acetates, amino-polyphosphonates (such as those in the DEQUEST$^R$ range) and phosphates and a wide variety of other poly-functional organic acids and salts, can also optionally be employed.

Citrate is particularly preferred as this functions as a buffer maintaining the composition at a pH in the range 3–5 on dilution. Typical levels of citrate range from 0.5–5%, with higher levels of 5–10% being used in concentrates and lower levels of 0.1–1% being used in sprayable products. Citric can be replaced by other suitable buffering agents to maintain the pH in this range. Citric is preferred for environmental reasons and a lack of residues.

Hydrotropes, are useful optional components. It is believed that the use of hydrotropes enables the cloud point of the compositions to be raised without requiring the addition of anionic surfactants. Preferably the formations according to the invention are free of anionics, or contain low levels of anionics, i.e. less than 50% of the level of the betaine.

Suitable hydrotropes include, alkali metal toluene sulphonates, urea, alkali metal xylene and cumene sulphonates, short chain, preferably $C_2$–$C_5$ alcohols and glycols. Preferred amongst these hydrotropes are the sulphonates, particularly the cumene and toluene sulphonates.

Typical levels of hydrotrope range from 0–5% for the sulphonates. Correspondingly higher levels of urea and alcohols are required. Hydrotropes are not required for dilute products.

Compositions according to the invention can also contain, in addition to the ingredients already mentioned, various other optional ingredients such as, solvents, colourants, optical brighteners, soil suspending agents, detersive enzymes, compatible bleaching agents, foam-control agents, gel-control agents, freeze-thaw stabilisers and opacifiers.

Preferred Compositions

The effectiveness of the compositions varies with the ratio of the components present. As mentioned above it is preferred that the ratio of surfactant to perfume (preferably insect repellent perfume) does not exceed 10:1 wt %. Preferably, the weight ratio of the surfactant:polymer exceeds 10:1.

Typically, the pH of the products according to the invention will lie in the range 3.5–5.5 as is. The pH of the diluted product may differ from this towards or above neutrality depending on the water hardness used for dilution. The pH of the neat product is above 3.0 so as to reduce the possibility of damage to surfaces and below 6.0 so as to get effective cleaning with the nonionic polymer combination.

The most preferred pH of the composition lies in the range 3.5–5.0

Neat compositions according to the invention preferably comprise at least 50% water, more preferably at least 75% water, most preferably 99–82% water Preferred compositions according to the invention have a pH of 3.5–5.5 and comprise:

a) 1–10% wt of an ethoxylated alcohol, b) 0.1–4% wt of a carboxylate polymer, c) 0.2–4% wt of a perfume material, and, d) 82–99% water, wherein the weight ratio of (a):(c) does not exceed 10:1.

Particularly preferred compositions according to the invention have a pH of 3.5–5.5 and comprise:

a) 1–10% wt of an ethoxylated alcohol, b) 0.1–4% wt of a carboxylate polymer, c) 0.2–4% wt of a terpenoid insect repellent material, and, d) 82–99% water, wherein the weight ratio of (a):(c) does not exceed 10:1.

In the most particularly preferred compositions according to the invention the formulations have a pH of 4–5 and comprise:

a) 2–5% wt of an ethoxylated alcohol, b) 0.1–1% wt of a polyacrylic acid polymer, c) 0.2–2% wt of a perfume comprising at least one terpenoid insect repellent material, and, d) 1–2% wt hydrotrope e) the balance water and minors,

EXAMPLES

In the following examples components are identified as follows:

Nonionic A :DOBANOL (TM) 23–6.5; ethoxylated alcohol.

Nonionic B :IMBENTIN (TM) 91-350FA; ethoxylated alcohol,

Anionic :PETRELAB (TM) 550; Na-linear alkyl sulphonate,

Cationic :CATIGENE (TM) DC100; myrystyl dimethyl benzyl ammonium chloride,

Soap :PRIFAC (TM) 7910; K-soap,

Polyacrylic acid :VERSICOL (TM) E11; polyacrylic acid.

Hydrotrope :Sodium Cumene Sulphonate,

Solvent :Butyl Digol (TM); diethylene glycol mono n-butyl ether,

Perfume A:A perfume comprising 54% limonene

Perfume B:A perfume containing equal proportions of limonene, linalol, ionyl acetate, diethylphthalate, methyldihydrojasmonate, hexyl cinnaminic aldehyde and galaxolide.

Perfume C :A perfume comprising 80% limonene.

1. Examples Using Perfume A

Compositions of examples 1–4 were prepared by mixing the components in the proportions given in table 1 below. As in the rest of this specification all component proportions are as wt % unless stated otherwise.

In a typical example, 35 g of non-ionic surfactant (Imbentin 91-350FA) were dispersed with stirring at room temperature in 800 ml of demineralised water. 10 g of a 25% polyacrylic acid solution (Versicol E11) were added with the remaining water (141 ml) to the stirred surfactant solution, followed by perfume, 10 g, and sodium cumene sulphonate, 4 g.

Experiments were performed in an 6.0 square meter tiled room of which half the floor, divided diagonally, was treated with 10 ml the neat composition and half left untreated. The air in the room was changed four times an hour during the course of the experiment. Insects were introduced at the centre of the room. Repellency is defined as the percentage of insects (thirty *Blattella germanica* were used) which were in the untreated zone after 20 minutes. As can be seen from the above a repellency of 50% indicates that the composition had no effect.

TABLE 1

| EXAMPLE | 1 | 2 | 3 | 4 |
|---|---|---|---|---|
| COMPONENTS | | | | |
| Nonionic A | 2.92 | — | — | — |
| Nonionic B | — | 2.0 | 3.5 | 3.5 |
| Anionic | 4.08 | — | — | — |
| Oationic | — | 0.48 | — | — |
| Soap | 0.17 | — | — | — |
| Sodium Citrate | 1.0 | — | — | — |
| Sodium Carbonate | 3.0 | — | — | — |
| Polyacrylic acid | — | — | 0.25 | 0.25 |
| Hydrot rope | — | — | 0.4 | — |
| Solvent | — | — | — | 2.5 |
| Perfume | 1.0 | 1.0 | 1.0 | 1.0 |
| Water | | | to 100% | |
| Repellency | 72 | 70 | 100 | 100 |

From the above it can be seen that examples 3 and 4 show a marked improvement over comparative examples 1 and 2. When the experiment was continued for 24 hours the repellency of examples 1 and 2 did not increase substantially while that of examples 3 and 4 remained at 100%.

2. Examples Using Perfume B

Compositions of example 5 and 6 were prepared by mixing the following components in the proportions given in Table 2 below.

In a typical example, 35 g of non-ionic surfactant (Imbentin 91-350FA) were dispersed with stirring at room temperature in 800 ml of demineralised water. 10 g of a 25% solution of poly(acrylic acid) solution (Versicol E11) were added with the remaining water (130 ml) to the stirred surfactant, followed by perfume 5 g, and a 40% aqueous solution of sodium cumene sulphonate, 20 g.

TABLE 2

| Example | 5 (%) | 6 (%) |
|---|---|---|
| Imbentin (™) 91-350 FA | 3.5 | 3.5 |
| Poly(acrylic acid) | — | 0.25 |
| Sodium cumene sulphonate | 0.8 | 0.8 |
| Perfume B | 0.5 | 0.5 |
| Water | to 100% | |

Clean glass beads were used as a model surface. The beads were soaked overnight in 5% Decon (TM) solution, rinsed in demineralised water, and dried in a clean oven. 100 g of the dry beads were then carefully weighed into a 100 ml glass jar, and 40 ml of product added. The jar was rolled on a roller mixer (Luckham Multimix Major [TM]) for 1 minute.

After this time period the contents were poured into a polythene funnel fitted with a glass wool plug in the neck. When the beads had drained, they were carefully transferred to a flat bottomed glass dish. 25 g samples of beads were removed after 30 minutes, 1 hour, 2 hours and 4 hours.

The perfume remaining on the glass beads was recovered by solvent extraction. The beads (25 g) were transferred to a glass vial, 5 ml of iso-propyl alcohol added, and rolled for at least 30 minutes on a roller mixer. The concentration of individual perfume components present in the solvent was then determined by GC/MS analysis. Samples were injected onto a Finnigan (TM) Magnum GC/MS fitted with a 25 meter SGE BPX-5 glass capillary column of internal diameter 0.22 mm and film thickness of 0.25 mm. The total perfume levels in the extracts are listed in Table 3, and those of the individual perfume components in Tables 4 and 5.

TABLE 3

| ppm total perfume extracted from glass beads in iso- propyl alcohol | | |
|---|---|---|
| Time (hours) | Example 5 (ppm total perfume) | Example 6 (ppm total perfume) |
| 0.5 | 16.3 | 21.1 |
| 1.0 | 14.35 | 20.2 |
| 2.0 | 7.8 | 12.95 |
| 4.0 | 3.7 | 8.7 |

TABLE 4

Example 5: ppm of individual perfume components in isopropyl alcohol extracts

| Time (hours) | Limonene | Linalol | Ionyl acetate | Diethyl phthalate | Methyl dihydrojas-monate | Hexyl cinnamic aldehyde | Galaxol -ide |
|---|---|---|---|---|---|---|---|
| 0.5 | 0.005 | 0 | 0 | 3.89 | 3.73 | 4.5 | 4.13 |
| 1.0 | 0.02 | 0 | 0 | 3.27 | 3.25 | 4.1 | 3.71 |
| 2.0 | 0.022 | 0 | 0 | 1.53 | 1.55 | 2.57 | 2.12 |
| 4.0 | 0.073 | 0 | 0.005 | 0.59 | 0.60 | 1.38 | 1.07 |

TABLE 5

Example 6: ppm of individual perfume components in isopropyl alcohol extract

| Time (hours) | Limonene | Linalol | Ionyl acetate | Diethyl phthalate | Methyl dihydrojas-monate | Hexyl cinnamic aldehyde | Galaxol -ide |
|---|---|---|---|---|---|---|---|
| 0.5 | 0.023 | 0.046 | 0 | 5.23 | 4.65 | 5.65 | 5.53 |
| 1.0 | 0.018 | 0 | 0 | 4.9 | 4.39 | 5.62 | 5.34 |
| 2.0 | 0.045 | 0 | 0 | 2.7 | 2.64 | 3.98 | 3.62 |
| 4.0 | 0.073 | 0 | 0 | 1.6 | 1.65 | 2.91 | 2.49 |

The result in tables 3–5 show that higher perfume levels are retained for longer period with the product containing the polymer (example 6 as compared with the comparative example 5). Levels of '0' indicate that the perfume was not found within the limits of experimental error.

3. Sensory Evaluation of Perfume A

Two general purpose cleaning formulations, referred to as examples 7 and 8 were prepared by mixing the following components in the proportions given in table 6 below.

In a typical example, 35g of non-ionic surfactant (Imbentin 91-350FA) were dispersed with stirring at room temperature in 800 ml of demineralised water. 10 g of a 25% solution of poly(acrylic acid) solution (Versicol E11) were added with the remaining water (130 ml) to the stirred surfactant, followed by perfume 5 g, and a 40% aqueous solution of sodium cumene sulphonate, 20 g.

TABLE 6

| Example | 7 (%) | 8 (%) |
|---|---|---|
| Imbentin (™) 91-350 FA | 3.5 | 3.5 |
| Poly(acrylic acid) | — | 0.25 |
| Sodium cumene sulphonate | 0.8 | 0.8 |
| Perfume A | 0.5 | 0.5 |
| Water | to 100% | |

Clean 3"×2" glass slides were used as model surfaces. Prior to use, the slides were soaked overnight in 5% Decon solution, thoroughly rinsed in demineralised water, arid dried in a clean oven. Each slide was fitted with two small Bulldog clips at either end to facilitate handling without contaminating the slide surface. 0.05 ml of product was applied to the slide and smeared with the pipette tip to cover the whole of the upper surface. The slides were left to dry for 20 minutes. Three slides per product were prepared, and were assessed by paired comparison technique by a panel of six assessors. Panellists were asked to select one slide from each pair which smelled the strongest of perfume.

TABLE 7

Strongest residual perfume - number of panellists

| Time (hours) | Example 7 | Example 8 |
|---|---|---|
| 0 | 5 | 13 |
| 0.5 | 8 | 10 |
| 1.0 | 7 | 11 |
| 2.0 | 4 | 14 |
| 5.0 | 7 | 11 |

Time zero was taken as 20 minutes after application of the product. The results presented in Table 7 below show that at all times most panellists considered that perfume lasted longest on the product containing the polymer (example 8 as compared with comparative example 7).

4. Further Examples Using Perfume C

Two systems (example 10 and comparative example 9) were prepared with components as given in Table 8 below. Both systems contained nonionic at 16.0% and a limonene based perfume at 1%. One also contained 1.0% PAA in the form of Versicol E11 (TM) ex Allied Colloids. Both products were made up to 100% with distilled water.

TABLE 8

| Example | 9 (%) | 10 (%) |
|---|---|---|
| Imbentin C/95/35 | 16.0 | 16.0 |
| Polyacrylic Acid | — | 1.0 |
| Perfume C | 1.0 | 1.0 |
| Water | to 100% | |

(Perfume C contains approx 80% limonene)

Glass surfaces were treated with both products, then allowed to stand for 4 hours before sensory assessment (human nose) for relative perfume intensity, followed by solvent extraction and GC/MS analysis. Samples A, D and E were treated with product 9. Samples B, C and F were treated with product 10. Sensory data is given in table 9 below.

TABLE 9

| | Number of Selections | | | | | | | | |
|---|---|---|---|---|---|---|---|---|---|
| Comparisons | A | vs | B | C | vs | D | E | vs | F |
| Strongest Perfume | 2 | | 7 | 7 | | 2 | 1 | | 8 |

These results show a significant number of selections for product 10 having the greatest perfume impact.

In order to acquire non-sensory (GC/MS) data, the surfaces assessed by sensory testing were extracted with isopropyl alcohol and analysed by GC/MS. Two of the major components of perfume C were monitored; limonene and linalol. Results are given in Table 10 below.

TABLE 10

Relative amounts of perfume components retained on treated surfaces

| | PERFUME COMPONENT (ppm in soln.) | |
|---|---|---|
| SAMPLE | Limonene | Linalol |
| A | 0.333 | 2.652 |
| B | 7.082 | 5.346 |
| C | 3.800 | 6.190 |
| D | 0.215 | 2.302 |
| E | 0.173 | 2.249 |
| F | 8.372 | 6.459 |

The results from table 10 show a much greater amount of perfume was retained on surfaces treated with product 10. (average figures show 2.5 times more for linalol and 25 times more for limonene) as compared with the comparative product 9.

In order to show benefits from diluted products, products 9 and 10 were diluted by a factor of 1 to 100 and applied to glass surfaces. These were assessed for strongest perfume impact, comparing systems with and without polymer by sensory testing (human nose). The surfaces were assessed after 1, 2 and 4 hours, comparing fresh samples at each time in duplicate sets. Results are given in table 11 below.

TABLE 11

| DRYING TIME (HOURS) | NUMBER OF ASSESSMENTS | | | |
|---|---|---|---|---|
| | FIRST SET | | SECOND SET | |
| | NO PAA | WITH PAA | NO PAA | WITH PAA |
| 1 | 1 | 8 | 4 | 5 |
| 2 | 0 | 7 | 1 | 6 |
| 4 | 1 | 7 | 0 | 8 |

The overall result in Table 11 shows a ratio of 6:1 in favour of the system containing PAA having the greatest perfume impact.

We claim:

1. A method of cleaning a glass surface so as to impart a residual perfume benefit thereupon said method consisting essentially of the step of contacting the glass surface with a composition having a ph of 3.0–6.0 consisting of:

a) 0.1 to 30% wt. of a nonionic surfactant, said nonionic surfactant being the condensation product of C8–C22 alcohols with 2–12 moles of ethylene oxide;

b) 0.01–5% wt. Of a carboxylate polymer having a molecular weight of at least about 50,000 and, c) 0.1–5% wt. Of an insect-repellant perfume.

2. Composition according to claim 1 wherein the carboxylate polyer is a polymer of acrylic or methacrylic acid or maleic anhydride, or a co-polymer of one or more of the same either together or with other monomers.

3. Composition according to claim 1 having a pH of 3.5–5.5 and consisting essentially of:

a) 1–10% wt. of an ethoxylated alcohol, b) 0.1–4 wt. of a carboxylate polymer, c) 0.2–4% wt. of a terpenoid insect repellent perfume, and, d) 82–99 water, wherein the weight ration of (a):(c) does not exceed 10:1.

4. Composition according to claim 1 wherein the perfume is selected from the group comprising limonene, carvone, cineole, linalool, Gum Camphor, citronellal, alpha and beta terpenol, fencholic acid, borneol, iso borneol, bornyl acetate, iso bornyl acetate and mixtures thereof.

* * * * *

UNITED STATES PATENT AND TRADEMARK OFFICE

CERTIFICATE OF CORRECTION

PATENT NO. : 6,019,855

DATED : February 1, 2000

INVENTOR(S) : Finch, et. al.

It is certified that error appears in the above-identified patent and that said Letters Patent is hereby corrected as shown below:

Title page, item [73], Assignee: should read --

" Home & Personal Care USA," to read

-- Lever Brothers Company, Division of Conopco, Inc., --

Signed and Sealed this

First Day of May, 2001

Nicholas P. Godici

*Attest:*

NICHOLAS P. GODICI

*Attesting Officer*

*Acting Director of the United States Patent and Trademark Office*